US006612783B2

(12) United States Patent
Stankus et al.

(10) Patent No.: US 6,612,783 B2
(45) Date of Patent: Sep. 2, 2003

(54) CABLE BOLT WITH MIXING DELAY DEVICE

(75) Inventors: John C. Stankus, Canonsburg, PA (US); John G. Oldsen, Butler, PA (US)

(73) Assignee: Jennmar Corporation, Pittsburgh, PA (US)

( * ) Notice: Subject to any disclaimer, the term of this patent is extended or adjusted under 35 U.S.C. 154(b) by 0 days.

(21) Appl. No.: 10/071,631

(22) Filed: Feb. 7, 2002

(65) Prior Publication Data

US 2002/0110426 A1 Aug. 15, 2002

Related U.S. Application Data

(60) Provisional application No. 60/267,988, filed on Feb. 9, 2001.

(51) Int. Cl.[7] ..... E21D 20/00
(52) U.S. Cl. ..... 405/259.5; 405/302.2
(58) Field of Search ..... 405/302.1, 302.2, 405/259.1, 259.4, 259.5, 259.6

(56) References Cited

U.S. PATENT DOCUMENTS

| | | | | |
|---|---|---|---|---|
| 4,188,158 A | | 2/1980 | Donan, Jr. et al. | 405/259 |
| 4,295,760 A | * | 10/1981 | Warner | 405/259.1 |
| 5,222,835 A | * | 6/1993 | Wright | 405/259.6 |
| 5,556,234 A | | 9/1996 | Oldsen et al. | 405/259.1 |
| 5,885,034 A | | 3/1999 | Fergusson | 405/302.1 |
| 5,919,006 A | * | 7/1999 | Calandra, Jr. et al. | 405/302.2 |
| 6,176,638 B1 | | 1/2001 | Kellison et al. | 403/268 |
| 6,270,290 B1 | * | 8/2001 | Stankus et al. | 405/259.6 |

* cited by examiner

*Primary Examiner*—Heather Shackelford
*Assistant Examiner*—Lisa M. Saldano
(74) *Attorney, Agent, or Firm*—Webb Ziesenheim Logsdon Orkin & Hanson, P.C.

(57) ABSTRACT

A mixing delay device for use with tensionable cable bolts wherein the mixing delay device compresses or is uncompressed in response to a compression force applied to the mixing delay device, wherein the mixing delay device increases resin mixing time, provides a visual indication of tensioning, and helps to reduce de-tensioning of the tensionable cable bolt.

20 Claims, 2 Drawing Sheets

CABLE BOLT WITH MIXING DELAY DEVICE

CROSS-REFERENCE TO RELATED APPLICATION

This application claims the benefit of earlier filed U.S. Provisional Patent Application Serial No. 60/267,988, filed Feb. 9, 2001, and entitled "Cable Bolt with Mixing Delay Device."

BACKGROUND OF THE INVENTION

1. Field of the Invention

The present invention relates to mine roof bolts and, more particularly, to tensionable cable bolts having a mixing delay device.

2. Brief Description of the Prior Art

Mine roofs are often supported by rock bolts, cable bolts, trusses, and bearing plates. A rock bolt generally is a solid longitudinally extending rod, such as concrete reinforcement bar, having a drive head integrally formed or otherwise attached to a first end of the rod. In contrast, a cable bolt typically is a multi-strand cable segment with a drive head attached to a first end of the cable segment by welding, swaging, or other suitable method. Either of these types of mine roof bolts may be tensionable or non-tensionable, with tensionable rock or cable bolts generally including a mechanical anchor. U.S. Pat. No. 4,419,805 to Calandra, Jr., assigned to the applicant of the present invention and herein incorporated by reference in its entirety, discloses a tensionable rock bolt. U.S. Pat. No. 6,074,134 to Stankus et al., assigned to the applicant of the present invention and herein incorporated by reference in its entirety, discloses a tensionable cable bolt.

Because tensionable cable bolts are less rigid than tensionable rock bolts, tensionable cable bolts are more likely to bend without breaking if rock strata above the mine roof shifts after installation of the tensionable cable bolt. However, one drawback of known tensionable cable bolts is torsional deformation when torque is applied to a drive head positioned adjacent to a first end of the tensionable cable bolt. When torque is applied to the drive head, a mechanical anchor and/or resin positioned between the first end and a second end of the tensionable cable bolt restrains rotational movement of the cable bolt while the first end of the tensionable cable bolt is left unencumbered. Continued rotation at the first end tends to cause twisting of the tensionable cable bolt between the mechanical anchor/resin and the first end of the tensionable cable bolt. When installation of the tensionable cable bolt is complete and torque from a bolt installation machine is removed, the twisted portion of the tensionable cable bolt can untwist, which causes the tension applied to the tensionable cable bolt to be reduced. To counteract tensional deformation, a sleeve or buttons may be fixed to the portion of the tensional cable bolt susceptible to torsional deformation. However, these additional components can add to the cost of manufacturing a tensionable cable bolt.

Another problem related to tensionable cable bolts is that it is often difficult to tell whether or not the tensionable cable bolt has been properly tensioned. If the tensionable cable bolt is not tensioned properly, it will not adequately support a mine roof. Causes of improper tensioning include the torsional deformation discussed earlier, inadequately mixed resin and adhesive, or non-gripping or non-deployment of the mechanical anchor. However, each of these problems occurs inside the bore hole and are, therefore, obscured from view.

Hence, a need remains for a mine roof cable bolt which resists torsional deformation during installation with subsequent loss of tension, increases resin mixing time, and provides an affirmative visual indication of proper tensioning.

SUMMARY OF THE INVENTION

It is therefore an object of the present invention to provide a cable bolt that resists torsional deformation, delays tensioning to increase mixing time, and provides a visual indication that the cable bolt is properly tensioned.

In general, the present invention includes a mine roof support device having an elongated body, such as a multi-strand cable segment, having a first end, a second end, and forming an exterior surface. A mechanical anchor may be positioned between the first end and the second end of the elongated body, a drive head may be positioned adjacent to the first end of the elongated body, and a mixing delay device may be positioned between the drive head and the mechanical anchor.

The mixing delay device is configured to withstand a predetermined amount of an externally applied compression force, and then compress when the externally applied compression force exceeds the resisting force. Once compressed, the mixing delay device continues to exert the resisting force against the externally applied compression force. Suitable mixing delay devices include a lock washer, a Belleville type of washer, or other suitable device.

A flat washer may be positioned between the mixing delay device and the second end of the elongated body, a bearing plate may be positioned between the mixing delay device and the mechanical anchor, a barrel and wedge assembly may be positioned between the drive head and the mixing delay device, a stiffening sleeve defining a hollow cavity configured to receive the elongated member may be positioned adjacent to the barrel and wedge assembly, and a material coating, forming an optional textured surface, may be positioned on the exterior surface of the elongated body. A button may be positioned between the first end and the second end of the elongated body.

One method of supporting a mine roof is also included. The method generally includes the steps of a) drilling a bore hole in a mine roof, wherein the mine roof defines a wall surrounding the bore hole; b) inserting resin in the bore hole; c) providing an elongated body comprising a first end, a second end, a mechanical anchor positioned between the first end and the second end, a drive head positioned adjacent to the first end, and a mixing delay device positioned between the mechanical anchor and the drive head; d) inserting the second end of the elongated body into the bore hole; and e) rotating the elongated body in the bore hole. Additional steps may include f) engaging the mechanical anchor with the wall surrounding the bore hole after the step of rotating the elongated body in the bore hole; g) mixing the resin in the bore hole after the step of rotating the elongated body in the bore hole; h) advancing the elongated body into the bore hole after the step of rotating the elongated body in the bore hole; i) delaying the advancement of the elongated body into the bore hole after the step of rotating the elongated body in the bore hole; j) compressing the mixing delay device with a compression force after the step of delaying the advancement of the elongated body into the bore hole; and k) inspecting the mixing delay device after the step of compressing the mixing delay device with a compression force.

As stated earlier, the present invention helps an elongated body such as a multi-strand cable segment resist torsional deformation during installation, increases resin mixing time, and provides an affirmative visual indication of proper tensioning.

These and other advantages of the present invention will be clarified in the Detailed Description of the Preferred Embodiments and the attached figures in which like reference numerals represent like elements throughout.

DETAILED DESCRIPTION OF THE PREFERRED EMBODIMENTS

Figure 1:
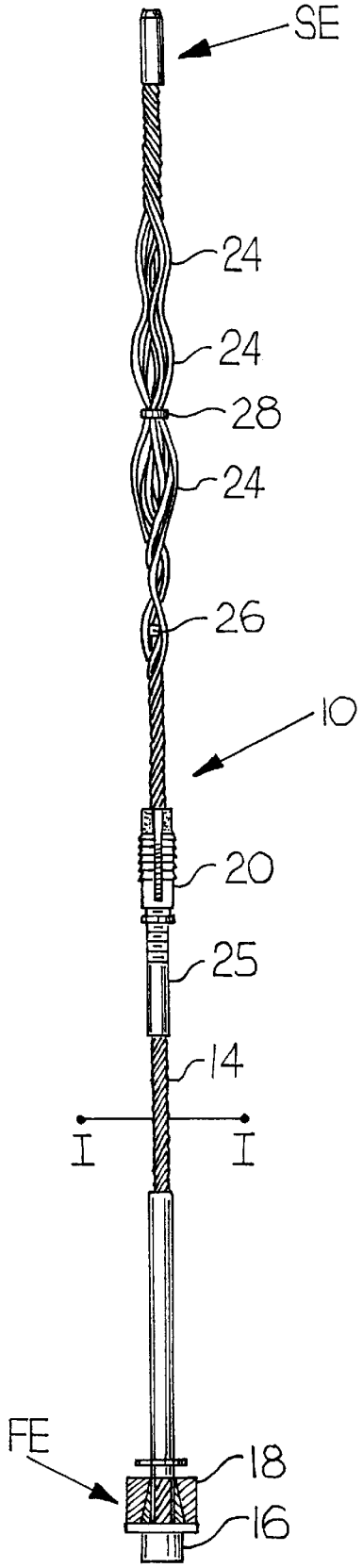
FIG. 1 is a side view of a first tensionable cable bolt.

One tensionable cable bolt 10 according to the present invention is generally shown in FIG. 1. The tensionable cable bolt 10 includes a cable segment 14, preferably a multi-strand cable segment constructed from steel or other suitable material. The cable segment 14 preferably has a drive head 16 integrally formed or otherwise attached to a first end FE of the cable segment 14, with a conventional load-bearing barrel and wedge assembly 18 positioned adjacent to the drive head 16. A suitable drive head 16 and barrel and wedge assembly 18 are disclosed in U.S. Pat. No. 5,829,922 to Calandra, Jr. et al., assigned to the owner of the present invention and herein incorporated by reference in its entirety. However, other drive heads 16 integrally formed with the cable segment 14, or otherwise attached to the cable segment 14 by welding, swaging, casting, or other suitable method are clearly contemplated.

The tensionable cable bolt 10 includes a mechanical anchor 20, such a three or more prong shell and wedge combination, which is attached to the cable segment 14 via an externally threaded sleeve 25 positioned on an exterior surface of the cable segment 14 between the first end FE and a second end SE of the cable segment 14. One acceptable mechanical anchor is generally disclosed in U.S. patent application Ser. No. 09/384,524, filed Aug. 27, 1999, entitled "Tensionable Cable Bolt", assigned to the owner of the present invention and herein incorporated by reference in its entirety. U.S. patent application Ser. No. 09/384,524 is a continuation-in-part of the application resulting in U.S. Pat. No. 6,074,134 to Stankus et al., also assigned to the owner of the present invention and previously incorporated by reference in its entirety. The cable segment 14 of the tensionable cable bolt 10 may also form resin mixing devices such as birdcages 24, nutcages 26, or buttons 28. A stiffening sleeve 30 defining a hollow cavity configured to receive the cable segment 14 may be positioned adjacent to the barrel and wedge assembly 18.

Figure 2:
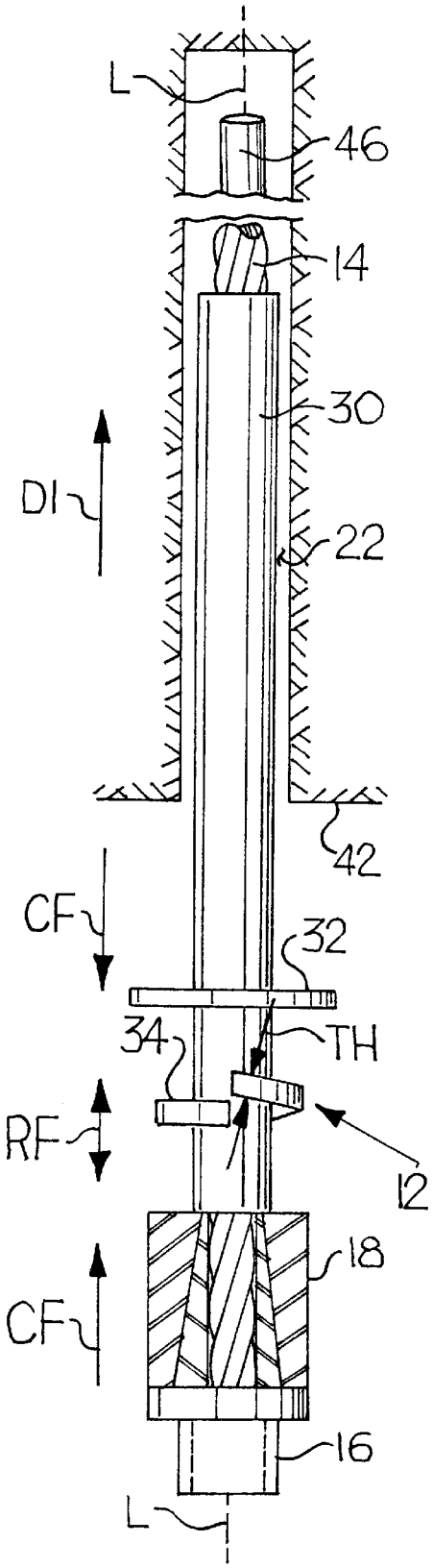
FIG. 2 is a sectional view of the tensionable cable bolt shown in FIG. 1, taken along section line I—I, having a first embodiment mixing delay device.

FIG. 2 shows a first embodiment of a mixing delay device 12 according to the present invention. The mixing delay device 12 is configured to provide a resisting force RF against compression. When a compression force CF is applied to the mixing delay device 12, such as when the mixing delay device 12 is sandwiched between a bearing plate or optional flat washer 32 and the barrel and wedge assembly 18 during rotation of the drive head 16 with mine roof bolting equipment, the resisting force RF prevents the mixing delay device 12 from compressing, thus extending the resin mixing time. When the compression force CF exceeds the resisting force RF, the mixing delay device 12 compresses. In other words, the mixing delay device 12 is initially rigid and provides the resisting force RF that initially withstands the compression force CF. Then, the mixing delay device 12 becomes elastic over increased rotation of the drive head 16 and compresses when the compression force CF exceeds the resisting force RF of the mixing delay device 12, so that resin mixing time is extended. However, even while compressed, the mixing delay device 12 still exerts the resisting force RF against the barrel and wedge assembly 18 and the bearing plate or optional flat washer 32. When the applied compression force CF is reduced or removed and the tensionable cable bolt 10 is not tensioned properly, the mixing delay device 12 retains or returns to its precompression shape. For example, the first embodiment mixing delay device 12' is a lock washer 34 or other suitable device positioned between the first end FE and the second end SE of the cable segment 14. The lock washer 34 should be durable, yet elastic enough to allow the lock washer 34 to compress when subjected to an applied compression force CF. In this embodiment the lock washer 34 is made from hardened steel or other suitable material. The thickness TH of the lock washer 34 and the type of material used to make the lock washer 34 can be selected to provide a desired resisting force RF commensurate with the application. It has been found that a lock washer 34 having a resisting force RF of approximately 750–1000 pounds force can delay the progress of the cable segment 14 into a bore hole 36 by approximately 2–3 seconds, which increases the mixing time by the same 2–3 seconds. Lock washers 34 providing a larger resisting force RF can provide a greater time delay.

Figure 3:
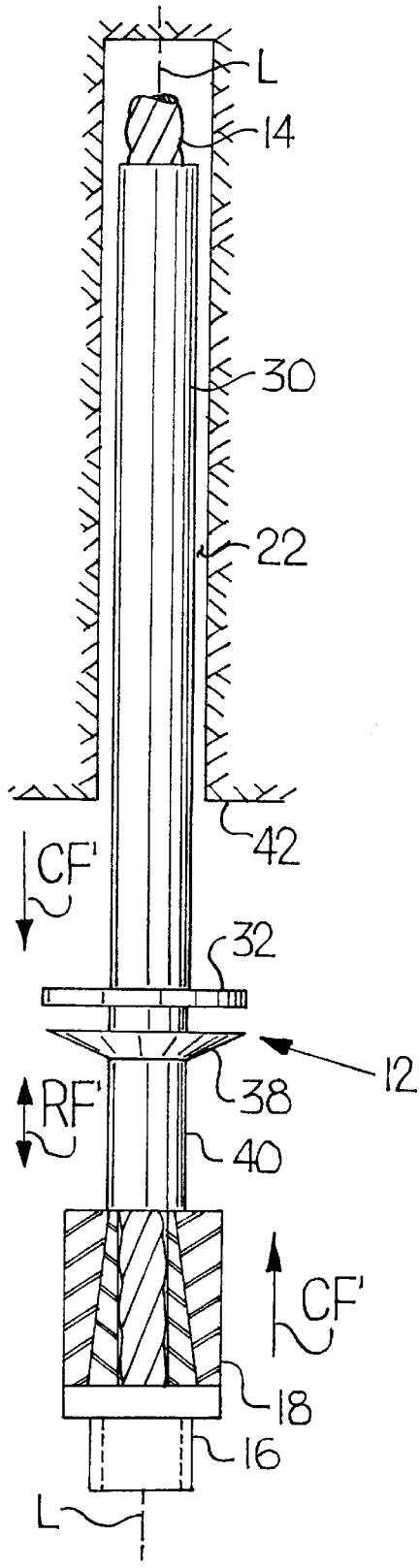
FIG. 3 is a sectional view of the tensionable cable bolt shown in FIG. 1, taken along section lines I—I, having a second embodiment mixing delay device.

FIG. 3 shows a second embodiment mixing delay device 12' according to the present invention. In this embodiment, the mixing delay device 12' is a Belleville type of washer 38 defining a hollow cavity 40. The Belleville type of washer 38 is also preferably made from hardened steel or other suitable material. The Belleville type washer 38, like the lock washer 34, provides a resisting force RF' against an externally applied compression force CF' until the resisting force RF' is overcome, but continues to provide a resisting force RF' after compression.

As shown in FIGS. 2–3, the optional flat washer 32 is preferably made from anti-friction hardened steel or other suitable material and may be positioned between the mixing delay device 12, 12' and a mine roof 42, or between the mixing delay device 12, 12' and a bearing plate. The flat washer 32 and its respective mixing delay device 12, 12' are each configured to move independently along a longitudinal length L of the cable segment 14, such as between the barrel and wedge assembly 18 and the mechanical anchor 20. As further shown in FIGS. 1–3, an optional stiffening sleeve 30 can be positioned around the cable segment 14 to protect the cable segment 14 during installation of the tensionable cable bolt 10. In this case, the flat washer 32 can be secured to the stiffening sleeve 30.

Figure 4:
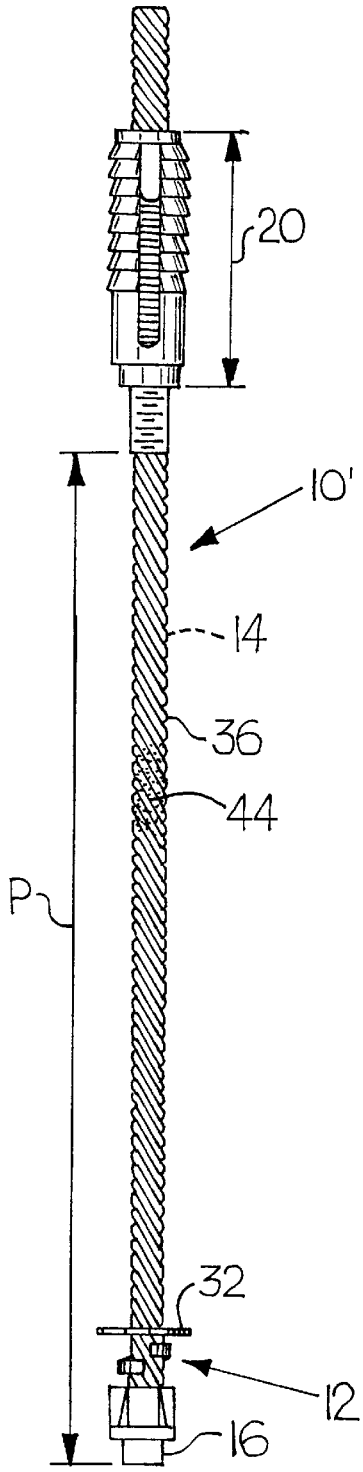
FIG. 4 is a side view of a second tensionable cable bolt having the first embodiment mixing delay device shown in FIG. 2.

FIG. 4 shows a tensionable cable bolt 10' having the first embodiment mixing delay device 12, a cable segment 14 having an exterior surface entirely coated in a coating material 36, and an optional textured surface 44. The coating material 36 strengthens the cable segment 14, including the portion P of the cable segment 14 susceptible to torsional deformation, while the textured surface 44 acts as a resin mixing device for mixing resin. The coating material 36 and the textured surface 44 are preferably the types disclosed in U.S. Pat. No. 5,208,777 to Proctor et al., herein incorporated by reference in its entirety. Moreover, the coating material 36 and textured surface 44 are both disclosed in U.S. patent application Ser. No. 09/660,819, entitled "Grit Surface Cable Products", filed Sep. 13, 2000, assigned to the owner of the present invention, and herein incorporated by reference in its entirety.

As stated earlier, the mixing delay device 12, such as those according to the first and second embodiments of the present invention can be used in connection with any type of tensionable cable bolt 10. However, for clarity, the following installation process will only refer to the first embodiment mixing delay device 12 and the tensionable cable bolt 10 shown in FIGS. 1–3, unless otherwise noted.

As shown in FIG. 2, installing a tensionable cable bolt 10 having a mixing delay device 12 generally includes the steps of drilling a bore hole 22 in a mine roof 42; inserting resin in the form of catalyst and hardening resin component package or packages 46 into the bore hole 22; inserting the second end SE (FIG. 1) of a cable segment 14 into the bore hole 22 to rupture the catalyst and hardening resin component package or packages 46; mixing the resin by rotating the cable segment 14 via mine roof bolt installation equipment attached to the drive head 16; continuing to rotate the cable segment 14 to simultaneously (i) expand the mechanical anchor 20 (FIG. 1) to engage with and grip an interior surface of the bore hole 22, (ii) mix the resin, and (iii) advance the cable segment 14 into the bore hole 22 in the direction of arrow D1; using the mixing delay device 12 to delay the advancement of the cable segment 14 into the bore hole 22 and to increase resin mixing time; compressing the mixing delay device 12; tensioning the tensionable cable bolt 10; inspecting the mixing delay device 12 for confirmation of tension; and allowing the resin to cure.

The mixing delay device 12 provides three main functions. First, the mixing delay device 12 momentarily prevents the advancement of the cable segment 14 into the bore hole 22 defined in the mine roof 42. As the drive head 16 and cable segment 14 of the tensionable cable bolt 10 are rotated, the mechanical anchor 20 expands and draws the threaded sleeve 25 of the mechanical anchor 20 along with the cable segment 14 into the bore hole 22. Continued rotation of the cable segment 14 causes the mixing delay device 12 to be gradually squeezed between the barrel and wedge assembly 18 and a bearing plate or between the barrel and wedge assembly 18 and the flat washer 32. However, because the mixing delay device 12 has a resisting force RF of some predetermined amount, such as 750–1000 pounds or any other desirable force, the mixing delay device 12 is configured not to yield until the applied force CF exerted on mixing delay device 12 by the barrel and wedge assembly 18 compression and the bearing plate or the flat washer 32 exceeds the resisting force RF of the mixing delay device 12. The time delay between the point where the barrel and wedge assembly 18 and bearing plate or flat washer 32 begin to exert an applied compression force CF against the mixing delay device 12 and the point that the resisting force RF of the mixing delay device 12 is overcome by the applied compression force CF represents additional resin mixing time. Depending on the size of the mixing delay device 12 and the material used to make the mixing delay device 12, the mixing time can be extended or reduced. As stated earlier, it has been found that a lock washer 34 having a resisting force RF of 750–1000 pounds force adds approximately 2–3 seconds of mixing time during installation of the tensionable cable bolt 10. However, any suitable resisting force RF can be used to obtain any suitable additional mixing time.

A second benefit of the mixing delay device 12 is that when the mixing delay device 12 yields and is compressed, the resisting force RF of the mixing delay device 12, which can be predetermined according to the size of the mixing delay device 12 and the material used to construct the mixing delay device 12, continues to be exerted on the barrel and wedge assembly 18 and on the bearing plate or the barrel and wedge assembly 18 and the flat washer 32. If a portion of the cable segment 14 susceptible to tensionable deformation P does suffer torsional deformation during installation of the tensionable cable bolt 10, the resisting force RF exerted by the mixing delay device 12 helps prevent the barrel and wedge assembly 18 and the drive head 16 from rotating in an untightening direction. This helps to prevent the twisted portion P of the cable segment 14 from untwisting in the bore hole 22 which, in turn, helps to prevent the installed tensionable cable bolt 10 from untensioning itself after installation.

A third benefit of the present invention is that the mixing delay device 12 provides an installer with a visual indication that the tensionable cable bolt 10 has been tensioned. If the mixing delay device 12 compresses and remains compressed after installation, then the installer visually inspecting the installed tensionable cable bolt 10 knows that the barrel and wedge assembly 18 is exerting an appropriate applied compression force CF as is necessary to compress the mixing delay device 12.

As is evident from the Detailed Description written above, the present invention provides additional resin mixing time, helps to reduce the risk of tensionable cable bolts detensioning after installation, and provides a visual indication of proper installation and tension. Each of these advantages helps ensure that the tensionable mine roof bolt is installed properly and securely.

The invention has been described with reference to the preferred embodiments. Obvious modifications and alterations will occur to others upon reading and understanding the preceding detailed description. It is intended that the invention be construed as including all such modifications and alterations.

We claim:

1. A mine roof support device configured to be inserted into a bore hole along with mixable resin comprising:

an elongated body having a first end and a second end;

a mechanical anchor positioned between the first end and the second end of the elongated body;

a drive head positioned adjacent to the first end of the elongated body; and a mixing delay device positioned between the drive head and the mechanical anchor, wherein the mixing delay device is initially rigid and provides a resisting force that initially withstands a predetermined amount of an externally applied compression force and then becomes elastic over increased rotation of the drive head and compresses when the externally applied compression force exceeds the resisting force of the mixing delay device, so that resin mixing time is extended.

2. The mine roof support device as claimed in claim 1 wherein the elongated body is a multi-strand cable segment having an exterior surface.

3. The mine roof support device as claimed in claim 2 further comprising a coating material positioned on the exterior surface of the elongated body.

4. The mine roof support device as claimed in claim 3 wherein the coating material forms an optional textured surface.

5. The mine roof support device as claimed in claim 1 wherein the mechanical anchor is selected from the group comprising a three prong anchor and a four prong anchor.

6. The mine roof support device as claimed in claim 1 further comprising a flat washer positioned between the mixing delay device and the second end of the cable.

7. The mine roof support device as claimed in claim 1 further comprising a bearing plate positioned between the mixing delay device and the mechanical anchor.

8. The mine roof support device as claimed in claim 1 further comprising a barrel and wedge assembly may be positioned between the drive head and the mixing delay device.

9. The mine roof support device as claimed in claim 1 further comprising a stiffening sleeve defining a hollow cavity, the hollow cavity defined by the stiffening sleeve configured to receive the elongated body and positioned adjacent to the barrel and wedge assembly.

10. The mine roof support device as claimed in claim 1 wherein the mixing delay device is a lock washer.

11. The mine roof support device as claimed in claim 1 wherein the mixing delay device is a Belleville type of washer.

12. A method of supporting a mine roof comprising the steps of:

a) drilling a bore hole in a mine root wherein the mine roof defines a wall surrounding the bore hole;

b) inserting resin in the bore hole;

c) providing an elongated body comprising a first end, a second end, a mechanical anchor positioned between the first end and the second end, a drive head positioned adjacent to the first end, and a mixing delay device positioned between the mechanical anchor and the drive head;

d)inserting the second end of the elongated body into the bore hole; and e)rotating the elongated body in the bore hole, wherein the mixing delay device is initially rigid and provides a resisting force that initially withstands a predetermined amount of an externally applied compression force and then becomes elastic over increased rotation of the drive head and compresses when the externally applied compression force exceeds the resisting force of the mixing delay device, so that resin mixing time is extended.

13. The method as claimed in claim 12 further comprising the steps of rotating the elongated body and engaging the mechanical anchor with the wall surrounding the bore hole.

14. The method as claimed in claim 13 further comprising the step of mixing the resin in the bore hole.

15. The method as claimed in claim 13 further comprising the step of advancing the elongated body into the bore hole.

16. The method as claimed in claim 13 further comprising the step of using the mixing delay device to delay the advancement of the elongated body into the bore hole.

17. The method as claimed in claim 13 further comprising the step of compressing the mixing delay device with a compression force.

18. The method as claimed in claim 13 further comprising the step of visually inspecting the mixing delay device after the step of compressing the mixing delay device.

19. A mine roof support device configured to be inserted into a bore hole along with mixable resin comprising:

a multi-strand cable segment having a first end and a second end;

a mechanical anchor positioned between the first end and the second end of the multi-strand cable segment;

a drive head positioned adjacent to the first end of the multi-strand cable segment; and a mixing delay device positioned between the drive head and the mechanical anchor, wherein the mixing delay device is initially rigid and provides a resisting force that initially withstands a predetermined amount of an externally applied compression force and then becomes elastic over increased rotation of the drive head and compresses when the externally applied compression force exceeds the resisting force of the mixing delay device, so that resin mixing time is extended.

20. The mine roof support device as claimed in claim 19 wherein the mixing delay device is selected from the group comprising a lock washer and a Belleville type of washer.

* * * * *

UNITED STATES PATENT AND TRADEMARK OFFICE

CERTIFICATE OF CORRECTION

PATENT NO. : 6,612,783 B2
DATED : September 2, 2003
INVENTOR(S) : John C. Stankus et al.

It is certified that error appears in the above-identified patent and that said Letters Patent is hereby corrected as shown below:

Column 5,
Line 52, "force CF" should read -- compression force CF --.

Column 7,
Line 29, "root" should read -- roof, --.

Signed and Sealed this

Seventeenth Day of February, 2004

JON W. DUDAS
*Acting Director of the United States Patent and Trademark Office*